US006517344B2

(12) United States Patent
Scanlon

(10) Patent No.: US 6,517,344 B2
(45) Date of Patent: Feb. 11, 2003

(54) GAS SUPPLY COUPLING FOR WATER HEATER

(75) Inventor: James Scanlon, Novi, MI (US)

(73) Assignee: Brass-Craft Manufacturing Company, Novi, MI (US)

( * ) Notice: Subject to any disclaimer, the term of this patent is extended or adjusted under 35 U.S.C. 154(b) by 25 days.

(21) Appl. No.: 09/730,092

(22) Filed: Dec. 5, 2000

(65) Prior Publication Data

US 2002/0068253 A1 Jun. 6, 2002

Related U.S. Application Data

(60) Provisional application No. 60/207,500, filed on May 26, 2000.

(51) Int. Cl.[7] ..... F23D 14/46; F24H 9/02

(52) U.S. Cl. ..... 431/343; 431/249; 122/19.2; 285/330

(58) Field of Search ..... 431/343, 350, 431/249; 122/494, 19.2; 220/694.1; 126/25 R, 41 R, 25 B, 512; 285/80, 89, 92, 31, 32, 201, 202, 203, 305, 330, 81

(56) References Cited

U.S. PATENT DOCUMENTS 2,359,846 A * 10/1944 Hayman ..... 285/32
2,371,347 A * 3/1945 Morrow ..... 122/494
3,605,653 A * 9/1971 Donnell ..... 126/25 B
4,621,839 A * 11/1986 Duell et al. ..... 285/330
4,924,816 A * 5/1990 Moore, Jr. et al. ..... 122/17.1
5,094,223 A * 3/1992 Gonzalez ..... 126/25 R
5,195,785 A * 3/1993 Jellison ..... 285/92
5,213,075 A * 5/1993 Stephen et al. ..... 126/25 B
5,335,411 A * 8/1994 Muller et al. ..... 285/202
5,704,400 A * 1/1998 Eldridge ..... 285/32
6,109,216 A * 8/2000 Reynolds et al. ..... 122/13.01
6,162,048 A * 12/2000 Griffioen et al. ..... 431/343

FOREIGN PATENT DOCUMENTS

GB 310693 A * 5/1929

* cited by examiner

*Primary Examiner*—Henry Bennett
*Assistant Examiner*—Josiah C. Cocks
(74) *Attorney, Agent, or Firm*—Edgar A. Zarins; Lloyd D. Doigan

(57) ABSTRACT

A gas supply coupling for a water heater incorporating a shield to close the opening to the combustion chamber. The coupling includes a supply tube, a connector extending through the shield and a gas supply line detachably connected to the connector. The connector is staked to the shield to prevent disassembly requiring that the entire coupling be removed from the combustion chamber prior to disassembly. The gas supply line includes a threaded fastener having a unique exterior configuration requiring a specialized tool for separation from the connector.

17 Claims, 2 Drawing Sheets

GAS SUPPLY COUPLING FOR WATER HEATER

RELATED APPLICATIONS

This application claims priority from U.S. Provisional Application No. 60/207,500 filed May 26, 2000.

BACKGROUND OF THE INVENTION

I. Field of the Invention

This invention relates to a gas supply coupling for delivering natural gas to the combustion chamber of a water heater and, in particular, to a coupling incorporating a shield which retards disconnection of the supply assembly without removal of the complete assembly.

II. Description of the Prior Art

Domestic water heaters use either electricity or a combustible fuel to heat a supply of water for use on demand by the homeowner. The fuel may include heating oil, propane or natural gas which are delivered to a combustion chamber proximate the water tank. The fuel is combusted within the combustion chamber to heat and maintain the water at a predetermined temperature. In order to service and deliver fuel the combustion element, the combustion chamber is typically open to the exterior of the water heater. This can create a path for other gases to reach the combustion element.

Prior art water heater combustion chambers eliminate exterior combustion by utilizing a functionally sealed combustion chamber which controls the gas flow exteriorly of the chamber. The sealed chamber introduces manufacturing and assembly problems. A sealed chamber eliminates many of the assembly tolerances between the control unit/regulator and burner. In addition, the gas supply must pass through a sealed door for delivery of the combustion fuel. The prior known sealed doors include a burner supply tube upset on both sides of the barrier. This provided the rigid attachment required for the burner but the resultant assembly was difficult to make with the regulator or control units.

SUMMARY OF THE PRESENT INVENTION

The present invention overcomes the disadvantages of the prior known gas supply couplings for water heaters by providing an integral supply coupling and combustion element with a shield to close the opening to the combustion chamber.

The supply coupling of the present invention generally includes a supply tube having an outlet through which the fuel is delivered for combustion proximate the water tank, a shield configured to close off the opening to the combustion chamber, a connector extending through the shield, and a gas supply line attached to the connector. The connector extending through the shield is designed such that the gas supply coupling can only be disassembled with specialized tools. To accomplish this, the entire supply coupling must be removed from the combustion chamber ensuring that the fuel will not be burned without the shield in place.

The connector extending through the shield includes a bulkhead fitting connected to the supply tube and having a male end extending through a similarly configured aperture in the bulkhead shield. In one embodiment, the bulkhead fitting includes staking which engages the shield to prevent rotation of the fitting in the bulkhead aperture. As an alternative, a lock nut may be mounted to the exterior end of the fitting until the shield is captured between the lock nut and the head of the fitting. The gas supply line is threadably attached to the male end of the fitting which is extending through the shield. In a preferred embodiment, the threaded fastener of the gas supply line has a tamper-proof exterior configuration requiring a specially configured tool to disengage the fastener of the supply line.

The bulkhead fitting of the present invention is physically staked to the door or bulkhead. The portion of the fitting passing through the bulkhead has a non-circular cross-section to facilitate alignment and resist rotation. The tolerances between the opening in the bulkhead and fitting passing therethrough are minimal in order to prevent a flame from passing through. To dissuade disassembly of the bulkhead the fitting connector was designed with a non-standard profile nut which will not mate with traditional tools.

Alternate embodiments of the connector include a bulkhead fitting welded to the bulkhead instead of staked or the use of a jamb nut on the outside of the bulkhead. The purpose of the tamper resistant nut is to direct service personnel to the proper connector at the control device to disassemble the supply line.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
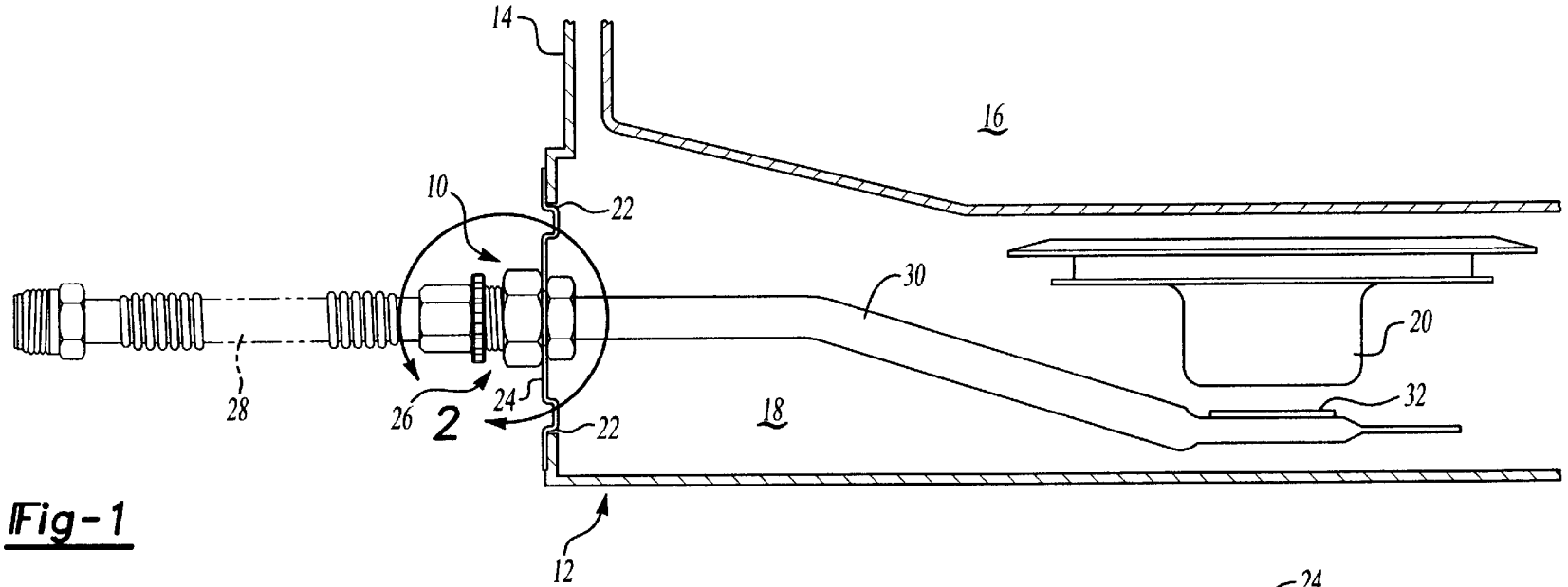
FIG. 1 is a side view of a gas supply coupling for a water heater embodying the present invention.

Referring first to FIG. 1, there is shown a gas supply coupling 10 in conjunction with a water heater 12 having a housing 14. The water heater housing 14 is compartmentalized to include a water tank 16 and a combustion chamber 18. Disposed within the combustion chamber 18 is a burner 20 in close proximity to the water tank 16. The gas supply coupling 10 of the present invention is designed to deliver fuel to the burner 20 for combustion proximate the water tank 16 thereby heating the water within the tank 16 to a predetermined temperature. The gas supply coupling 10 will be connected to a fuel supply (not shown) which is the preferred embodiment is natural gas although it is contemplated that the coupling 10 may be used with other fuel types including heating oil and propane. The combustion chamber 18 has an opening 22 to the exterior of the water heater 12 to facilitate access to the gas supply and combustion elements. However, this opening 22 also forms a pathway for foreign elements and gases to reach the burner 20 possibly affecting the operation of the water heater 12.

The gas supply coupling 10 is disposed within and extends through the opening 22 of the combustion chamber 18. The primary objective of the supply coupling 10 is to deliver combustible fuel to the burner 20 but the supply coupling 10 includes a bulkhead shield 24 configured to seat within the opening 22 thereby closing this pathway into the combustion chamber 18. Mounted in the shield 24 is a connector 26 providing interconnection between a gas supply line 28 and a gas supply tube 30. The gas supply line 28 is preferably a flexible line adapted to be connected to a gas supply. The gas supply tube 30 is preferably a rigid tube with an outlet port 32 at the burner 20 for delivering the fuel to the burner 20.

Figure 2:
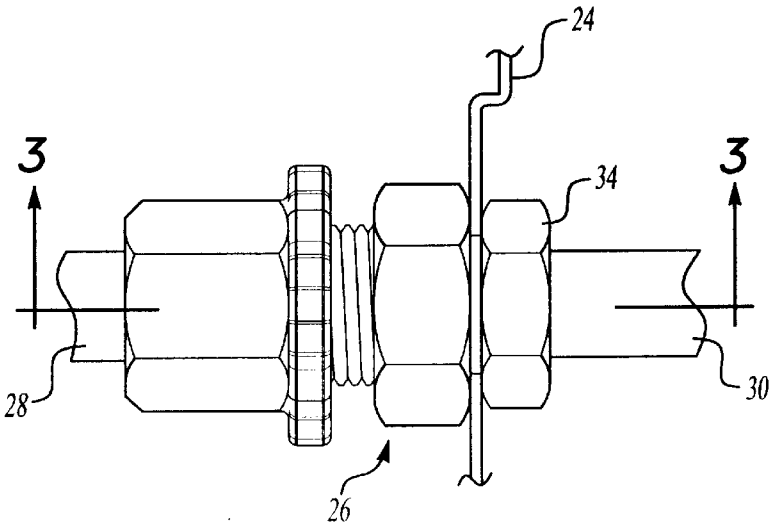
FIG. 2 is an enlarged view of the connector extending through the shield of the coupling.
Figure 3:
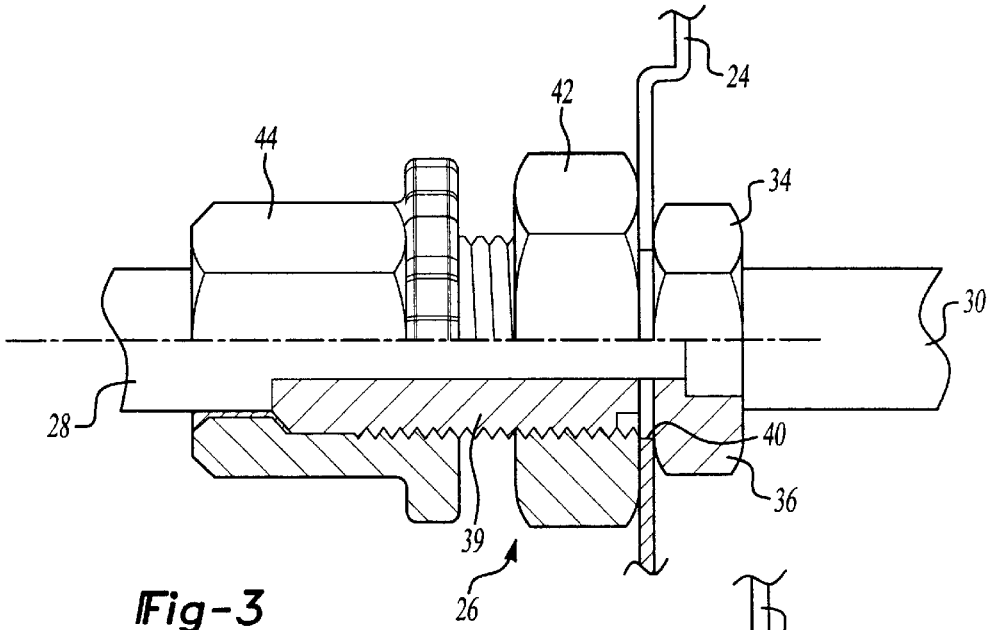
FIG. 3 is a partial cross-sectional view of the connector.

A first embodiment of the connector 26 (FIGS. 2 and 3) includes a bulkhead fitting 34 having a head 36 and a male end 38 extending through a similarly configured aperture 40 in the bulkhead 24. The male end 38 of the fitting 34 is threaded to threadably receive a fastener nut 42. The fastener nut 42 is used to sandwich the bulkhead 24 against the fitting head 36. The male end 38 of the fitting also receives a threaded nut 44 of the flexible gas supply line 28 to complete the fuel delivery connection.

Figure 4:
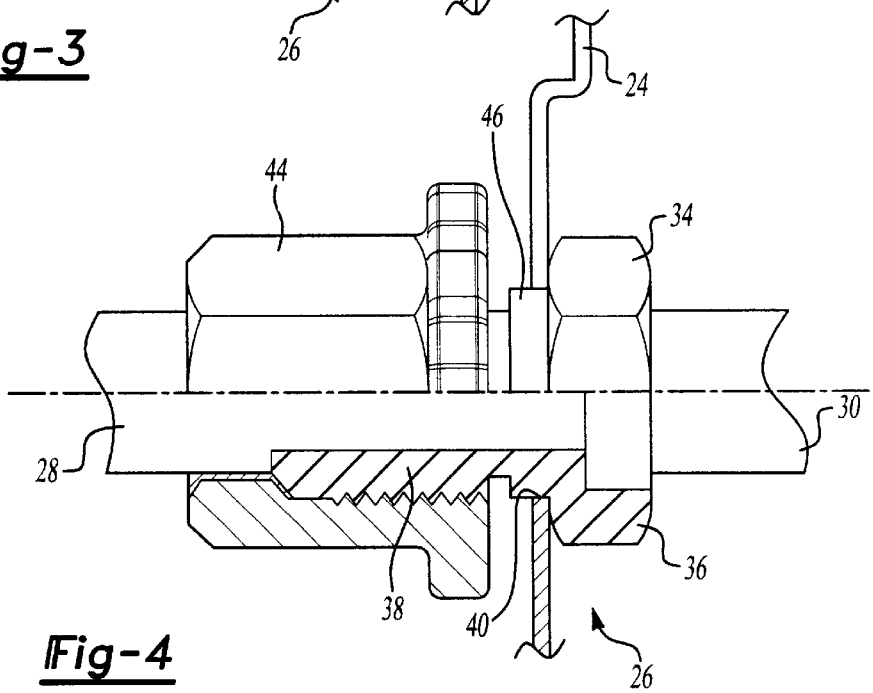
FIG. 4 is a partial cross-sectional view of an alternative embodiment of the connector.

A preferred embodiment of the connector 26 (FIG. 4) eliminates the fastener nut 42 limiting the capability of a user from disassembling the coupling 10 without first removing the entire coupling 10 from the combustion chamber 18. The bulkhead fitting 34 includes one or more stakes 46 proximate the head 36 and the non-circular cross-section of the fitting 34 to prevent rotation of the fitting 34 within the bulkhead shield 24. The staking operation deforms material on the male portion protruding through the shield 24 to prevent withdrawal of the bulkhead fitting 34 from the shield 24. Thereafter the gas supply line 28 can simply be connected to the male end 38 of the fitting 34.

Figure 5:
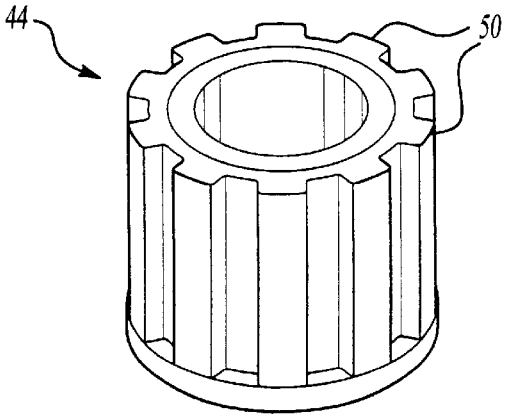
FIG. 5 illustrates the threaded fastener of the gas supply line.

FIG. 5 illustrates an alternative threaded nut 44 for the gas line which further reduces the ability of the user to simply disconnect the coupling 10. The exterior peripheral surface 49 of the nut 44 has a plurality of ribs or scallops 50 which require a specialized tool to grasp and disconnect the fastener 44. While the flats of a conventional nut lend themselves to be engaged by a standard hand tool such as a wrench, the peripheral surface 49 of the nut 44 may be configured such that the nut 44 is manipulable only with a specialized tool which conforms to the irregular configuration of the nut 44.

The foregoing detailed description has been given for clearness of understanding only and no unnecessary limitations should be understood therefrom as some modifications will be obvious to those skilled in the art without departing from the scope and sprit of the appended claims.

What is claimed is:

1. A gas supply coupling for delivering combustion gases to a combustion chamber of a heating device, said supply coupling comprising:

a supply tube having an outlet for combination fuel and an exterior end;

a connector attached to said exterior end of said supply tube;

a supply line detachably connected to said connector; and a shield mounted to said connector and adapted to fit within an opening of said combustion chamber, said connector attached to said shield by a staked fitting fixedly received within said shield to retard detachment of said shield from said connector.

2. The supply coupling as defined in claim 1 wherein said supply line is connected to said connector by a threaded fastener having an exterior configuration incapable of manipulation with a standardized tool.

3. The supply coupling as defined in claim 2 wherein said connector is attached to said shield by a staked fitting to retard detachment of said shield from said connector.

4. The supply coupling as defined in claim 1 wherein said staked fitting has a non-circular configuration and is matingly received within a similarly configured aperture in said shield whereby said fitting is prevented from rotating within said aperture.

5. The supply coupling as defined in claim 4 wherein said shield is configured to close the opening for the combustion chamber, said shield removably mounted within the opening to form a bulkhead for the combustion chamber.

6. The supply coupling as defined in claim 2 wherein said connector is secured to said shield by a locking nut, said locking nut cooperating with said connector to capture said shield.

7. The supply coupling as defined in claim 2 wherein said threaded fastener has a scalloped exterior configuration adapted to be manipulated with a specialized tool for removal of said threaded fastener from said connector.

8. The supply coupling as defined in claim 2 wherein said threaded fastener has a ribbed exterior configuration adapted to be manipulated- with a specialized tool for removal of said threaded fastener from said connector.

9. A gas supply coupling for delivering combustion gases to a combustion chamber for a water heater, the combustion chamber having an opening to the exterior of the water heater, said supply coupling comprising:

a supply tube having an outlet for combustion of the gases within the combustion chamber and an exterior end;

a connector mounted to said exterior end of said supply tube;

a bulkhead fixedly mounted to said connector using a staked fitting mounted on said connector and fixedly received within said bulkhead to prevent separation of said connector from said bulkhead, said bulkhead adapted to fit within the combustion chamber opening to enclose the combustion chamber; and a supply line detachably connected to said connector exteriorly of said bulkhead, said supply line connected to an exterior end of said connector by a threaded fastener having an exterior configuration incapable of manipulation with a standardized tool.

10. The supply coupling as defined in claim 9 wherein said connector is attached to said bulkhead by a staked fitting to retard detachment of said connector from said bulkhead.

11. The supply coupling as defined in claim 9 wherein said staked fitting has a non-circular configuration and is matingly received within a similarly configured aperture in said bulkhead whereby said fitting is prevented from rotating within said aperture.

12. The supply coupling as defined in claim 9 wherein said connector is secured to said bulkhead by a locking nut, said locking nut cooperating with said connector to capture said bulkhead.

13. The supply coupling as defined in claim 9 wherein said threaded fastener has a scalloped exterior configuration adapted to be manipulated with a specialized tool for removal of said threaded fastener from said connector.

14. The supply coupling as defined in claim 9 wherein said threaded fastener has a ribbed exterior configuration adapted to be manipulated with a specialized tool for removal of said threaded fastener from said connector.

15. A gas supply coupling for delivering combustion gases to a combustion chamber of a water heater, the combustion chamber having an opening to the exterior of the water heater, said supply coupling comprising:

a supply tube having an outlet disposed within the combustion chamber for combustion of the gases and an exterior end extending through the chamber opening;

a bulkhead adapted to fit within the combustion chamber opening to enclose the combustion chamber;

a connector attached to said exterior end of said supply tube and fixedly mounted within said bulkhead to prevent separation of said connector from said bulkhead, said connector attached to said bulkhead by a staked fitting having a non-circular configuration and matingly received within a similarly configured aperture in said bulkhead whereby said fitting is prevented from rotating within said aperture; and a supply line detachably connected to said connector exteriorly of said bulkhead, said supply line connected to an exterior end of said connector by a threaded fastener having an irregular exterior configuration.

16. The supply coupling as defined in claim 15 wherein said threaded fastener has a scalloped exterior configuration adapted to be manipulated with a specialized tool for removal of said threaded fastener from said connector.

17. The supply coupling as defined in claim 15 wherein said threaded fastener has a ribbed exterior configuration adapted to be manipulated with a specialized tool for removal of said threaded fastener from said connector.

* * * * *